US010626885B2

(12) United States Patent
Tejeda et al.

(10) Patent No.: US 10,626,885 B2
(45) Date of Patent: Apr. 21, 2020

(54) FAN AND MOUNTING BRACKET FOR AN AIR MOVER

(71) Applicant: Therma-Stor LLC, Madison, WI (US)

(72) Inventors: Marco A. Tejeda, Mount Horeb, WI (US); Michael J. Steffes, Poynette, WI (US); James A. Scharping, Jr., Madison, WI (US); Richard G. Giallombardo, Cottage Grove, WI (US); Jared M. Stearns, Madison, WI (US)

(73) Assignee: Thermo-Stor LLC, Madison, WI (US)

( * ) Notice: Subject to any disclaimer, the term of this patent is extended or adjusted under 35 U.S.C. 154(b) by 134 days.

(21) Appl. No.: 16/016,941

(22) Filed: Jun. 25, 2018

(65) Prior Publication Data

US 2018/0306206 A1 Oct. 25, 2018

Related U.S. Application Data

(63) Continuation of application No. 14/707,805, filed on May 8, 2015, now Pat. No. 10,161,417.

(51) Int. Cl.
*F04D 29/64* (2006.01)
*F04D 25/06* (2006.01)
(Continued)

(52) U.S. Cl.
CPC ..... *F04D 29/646* (2013.01); *F04D 19/002* (2013.01); *F04D 25/06* (2013.01);
(Continued)

(58) Field of Classification Search
CPC ..... F04D 29/646; F04D 19/002; F04D 25/06; F04D 29/4226; F04D 29/4246;
(Continued)

(56) References Cited

U.S. PATENT DOCUMENTS 4,076,197 A * 2/1978 Dochterman ..... B60H 1/00464 248/604
4,171,937 A 10/1979 Greenfield
(Continued)

FOREIGN PATENT DOCUMENTS

CA 2776814 A1 5/2011
CN 1288349 A 3/2001
(Continued)

OTHER PUBLICATIONS

Intellectual Property Australia, Australian Examination Report No. 1 for Standard Patent Application, Application No. 2016200806, dated Mar. 12, 2019, 3 pages.
(Continued)

*Primary Examiner* — Aaron R Eastman
(74) *Attorney, Agent, or Firm* — Baker Botts L.L.P.

(57) ABSTRACT

An air mover comprising a housing with a top portion is disclosed. A mounting bracket is recessed into the housing through the top portion of the housing. The mounting bracket comprises a plurality of top chords intersecting at a first portion of an inner web and a plurality of bottom chords intersecting at a second portion of the inner web. The mounting bracket also has a base plate coupled to the plurality of bottom chords. A motor is coupled to the base plate of the mounting bracket. An impeller is coupled to the motor. The air mover further comprises a housing cover that has an inlet ring positioned on the top portion of the housing. The housing cover is coupled to the mounting bracket via the mounting flanges and a portion of the inlet ring protrudes into the impeller inlet inside the housing.

16 Claims, 6 Drawing Sheets

(51) Int. Cl.

| | |
|---|---|
| ***F04D 29/42*** | (2006.01) |
| ***F04D 29/60*** | (2006.01) |
| ***F04D 29/62*** | (2006.01) |
| ***F04D 19/00*** | (2006.01) |

(52) U.S. Cl.
CPC ..... *F04D 29/4226* (2013.01); *F04D 29/4246* (2013.01); *F04D 29/601* (2013.01); *F04D 29/624* (2013.01)

(58) Field of Classification Search
CPC ..... F04D 29/44; F04D 17/00; F04D 25/08; F04D 29/52; F04D 29/30
USPC ..... 415/121.2
See application file for complete search history.

(56) References Cited

U.S. PATENT DOCUMENTS

| | | | | |
|---|---|---|---|---|
| 5,753,000 | A * | 5/1998 | Chiu | B01D 46/24 55/357 |
| 5,947,436 | A * | 9/1999 | Bucher | F04D 29/601 248/27.1 |
| 6,478,838 | B2 * | 11/2002 | McSweeney | F24F 3/16 55/467 |
| 7,028,963 | B1 * | 4/2006 | Silva | F04D 25/088 248/342 |
| 7,080,813 | B1 * | 7/2006 | Frampton | F04D 25/088 248/342 |
| 7,318,850 | B2 * | 1/2008 | Kaylan | B01D 46/26 55/467 |
| 7,513,754 | B2 * | 4/2009 | Clark | F16M 7/00 248/300 |
| D619,698 | S | 7/2010 | Emenheiser et al. | |
| 2006/0051205 | A1 * | 3/2006 | Platz | F04D 29/4233 415/206 |
| 2008/0174967 | A1 * | 7/2008 | Chang | F04D 29/582 361/719 |
| 2011/0200438 | A1 * | 8/2011 | Ruckert | F04D 25/0613 416/180 |
| 2012/0141264 | A1 | 6/2012 | Cui | |
| 2013/0247409 | A1 | 9/2013 | Black et al. | |
| 2013/0280108 | A1 | 10/2013 | Bearup et al. | |

FOREIGN PATENT DOCUMENTS

| | | | |
|---|---|---|---|
| CN | 201861590 | U | 6/2011 |
| CN | 103291661 | A | 9/2013 |
| CN | 104514737 | A | 4/2015 |

OTHER PUBLICATIONS

Dri-Eaz Products/Vela Pro Airmover; 2 pages; http://drieaz.com/_DEC/DEC_Product_Base.aspx?decID=2105.
Prochern Karcher Group; http://www.prochern.com/ViewCategories.aspx?Pid=1313; 2 pages, printed May 6, 2015.
Tornado Industries, Inc.; Windshear Storm; tornadovac.com/store/product.aspx?pid=263; 2 pages, printed May 6, 2015.
Mechatronics; AC Motorized Impellers; http://mechatronics.com/products/ac-motorized-impellers.php; 2 pages, printed May 6, 2015.
Mechatronics; Motorized Impellers; http://mechatronics.com/engineering/motorized-impellers.php; 2 pages, printed May 6, 2015.
Ecofit—BP; Data sheet; 2RREu15 192x40R P/N C45-A5; 1 page; http://www.rosenbergusa.com/FS/products/84/C45-A5-gb.pdf. , printed May 6, 2015.
Canadian Office Action issued in Appl. No. 2,920,570; dated May 9, 2016.
Canadian Office Action issued in Appl. No. 2,920,570; dated Jun. 10, 2016.
Communication from European Patent Office, dated Sep. 29, 2016, 9 pages.
Office Action from Canadian Intellectual Property Office, Application No. 2,920,570, dated Sep. 2, 2016, 3 pages.
Canadian Intellectual Property Office; Office Action for Application No. 2,947,975, dated Dec. 12, 2016, 3 pages.
EP Communication pursuant to Article 94(3) EPC; Application No. 16 157 715.0-1607; dated Jun. 1, 2017, 5 pages.
First Chinese Office Action, Application No. 201610294903.4, dated Feb. 6, 2018, 10 pages (with translation).
Second Chinese office Action, Application No. 201610294903.4, dated Sep. 14, 2018, 4 pages.

* cited by examiner

FAN AND MOUNTING BRACKET FOR AN AIR MOVER

RELATED APPLICATION

This application is a continuation of pending U.S. patent application Ser. No. 14/707,805 filed May 8, 2015 entitled "Fan and Mounting Bracket for an Air Mover."

TECHNICAL FIELD OF THE INVENTION

This disclosure relates generally to electro-mechanical devices and specifically to a fan and mounting bracket for an air mover.

BACKGROUND OF THE INVENTION

It is often necessary to dry, cool, or heat various surfaces by exposing them to propelled air. Current approaches for exposing such surfaces to propelled air are inefficient, ineffective, and generally unreliable. It is thus desirable to create a reliable and efficient system that can expose appropriate surfaces to propelled air for suitable periods of time.

SUMMARY OF THE INVENTION

According to embodiments of the present disclosure, disadvantages and problems associated with previous air movers may be reduced or eliminated.

In one embodiment, an air mover comprises a housing with a top portion. A mounting bracket is recessed into the housing through the top portion of the housing. The mounting bracket comprises a plurality of top chords intersecting at a first portion of an inner web and a plurality of bottom chords intersecting at a second portion of the inner web wherein the inner web comprises a plurality of vertical chords extending from the first portion of the inner web to the second portion of the inner web. Each of the plurality of top chords has an impeller clearance notch and a mounting flange. The mounting bracket also comprises a plurality of outer chords wherein each outer chord extends from a corresponding top chord to a corresponding bottom chord. The mounting bracket also has a base plate coupled to the plurality of bottom chords. A motor is coupled to the base plate of the mounting bracket. An impeller is coupled to the motor. The impeller comprises an inlet and a plurality of blades. The impeller is positioned so that a portion of the plurality of blades pass through the plurality of impeller clearance notches as the impeller rotates. The air mover further comprises a housing cover that has an inlet ring positioned on the top portion of the housing. The housing cover is coupled to the mounting bracket via the mounting flanges and a portion of the inlet ring protrudes into the impeller inlet inside the housing.

Certain embodiments may provide one or more advantages. One advantage of one embodiment may include increased efficiency of the air mover by maximizing the cross-sectional diameter of impeller inlet through which air can flow into the impeller. Another advantage of one embodiment may include increased robustness of the air mover that may be achieved by maintaining the alignment of the impeller inlet with the inlet ring over a long period of time.

Various embodiments of the invention may include none, some, or all of the above technical advantages. One or more other technical advantages may be readily apparent to one skilled in the art from the figures, descriptions, and claims included herein.

BRIEF DESCRIPTION OF THE DRAWINGS

To provide a more complete understanding of the present disclosure and the features and advantages thereof, reference is made to the following description taken in conjunction with the accompanying drawings, in which.

DETAILED DESCRIPTION OF THE INVENTION

Figure 1:
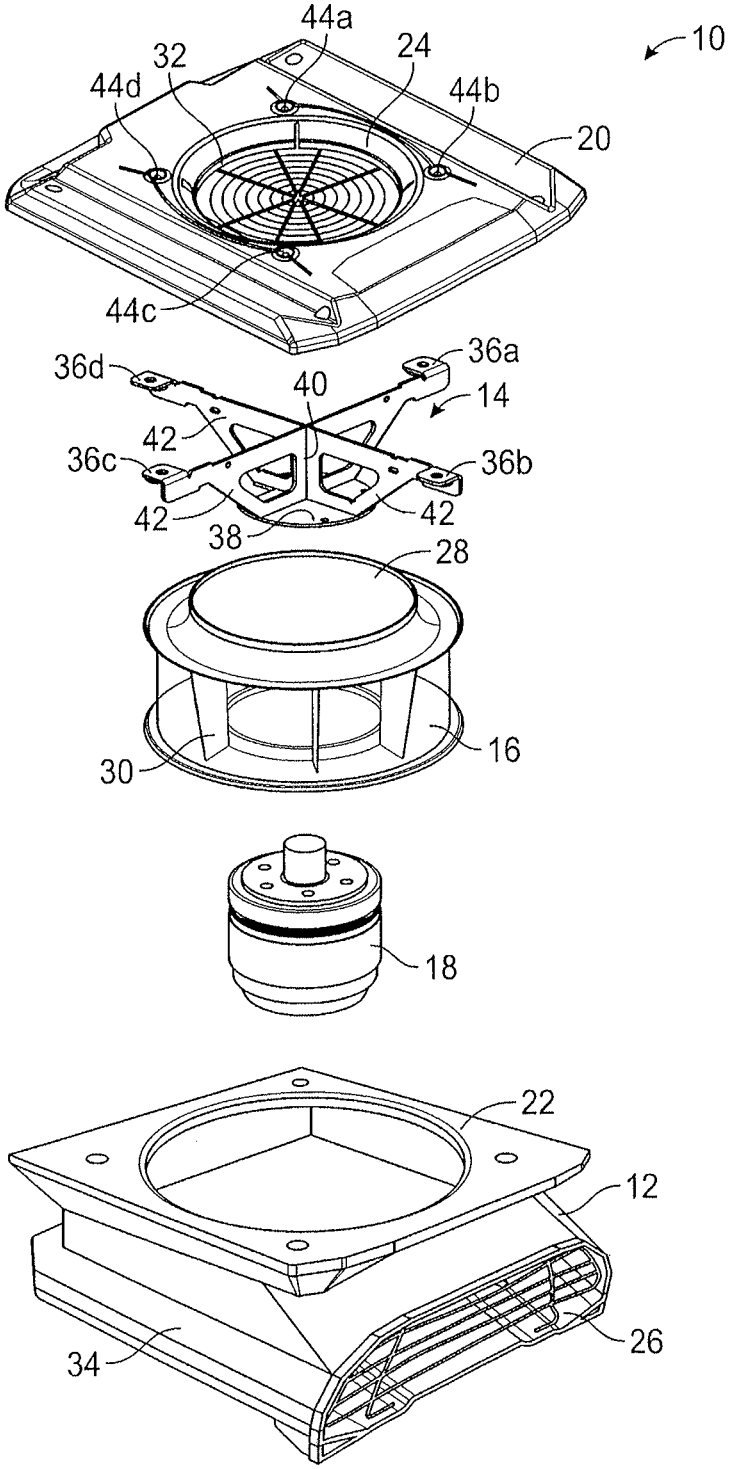
FIG. 1 illustrates an exploded view of an air mover and its impeller assembly.

FIG. 1 illustrates an exploded view of air mover 10 comprising housing 12, mounting bracket 14, impeller 16, motor 18, and housing cover 20. Housing cover 20 has an inlet ring 24 and is placed on a top portion 22 of housing 12. Impeller 16 and motor 18 are coupled to each other and mounted to mounting bracket 14. The mounting bracket 14, impeller 16, and motor 18 assembly is recessed into housing 12 through top portion 22 of housing 12. Mounting bracket 14 is then coupled to housing cover 20. This unique and novel configuration has several advantages, some of which are summarized here and described in greater detail below.

First, recessing impeller 16 and motor 18 through top portion 22 of housing 12 provides flexibility in sizing inlet ring 24. This flexibility allows for maximizing the area of impeller 16 into which unrestricted air flows by minimizing the gap between impeller 16 and inlet ring 24. Second, this configuration increases the efficiency and robustness of air mover 10 by maintaining the alignment of impeller 16 with respect to inlet ring 24 even when different portions of housing 12 are displaced or deformed. Because housing cover 20, motor 18, and impeller 16 are all coupled to mounting bracket 14, even if housing cover 20 that is coupled to housing 12 is displaced or deformed, impeller 16 remains aligned with inlet ring 24. And any damage to other portions of housing 12 does not affect the alignment of impeller 16 with respect to inlet ring 24.

In this example embodiment, housing 12 has a top portion 22 and a side opening 26. Impeller 16 has an inner portion 28 that is surrounded by blades 30. Motor 18 is placed inside inner portion 28 of impeller 16. Impeller 16 is then coupled to motor 18 and both motor 18 and impeller 16 are coupled to mounting bracket 14. As described in greater detail with reference to FIG. 3 below, motor 18 and impeller 16 are coupled to mounting bracket 14 so that motor 18 is recessed within impeller 16. In this embodiment, motor 18 is recessed within impeller 16 such that motor 18 protrudes out from the bottom of impeller 16. The coupled impeller 16 and motor 18 assembly is lowered into housing 12 through top portion 22. Once the impeller 16 and motor 18 assembly is lowered into housing 12, housing cover 20 is placed upon top portion 22. Mounting bracket 14 is then coupled to housing cover 20. Housing cover 20 is positioned on top portion 22 such that inlet ring 24 of housing cover 20 aligns with inner portion 28 of impeller 16. In this manner, when housing cover 20 is placed upon top portion 22 and is coupled to mounting bracket 14, lip 32 of inlet ring 24 protrudes into inner portion 28 of impeller 16.

Housing 12 may be any support structure that can house the components of air mover 10. In one embodiment, housing 12 may have a top portion 22, side opening 26, and a base portion 34. Air may flow into top portion 22 and out of side opening 26. Housing 12 may be formed of any combination of materials. Different portions of housing 12 may be formed of different materials. In various embodiments, housing 12 is made of rigid or flexible polymers. Side opening 26 of housing 12 may have a grill for preventing foreign objects from entering into housing 12. As described in greater detail with respect to FIG. 5A below, base portion 34 may have protrusions to facilitate stacking multiple air movers 10, and base portion 34 may have apertures for air flow out of housing 12.

Housing cover 20 may be placed upon top portion 22 of housing 12. In various embodiments, housing cover 20 may be made of various materials including materials that are different from the material forming housing 12. Housing cover 20 may be made of a rigid or a flexible polymer. Housing cover 20 may have an inlet ring 24. Inlet ring 24 may be any opening that allows fluid to flow into housing 12 through housing cover 20. In some embodiments, inlet ring 24 may be formed within housing cover 20 while in other embodiments inlet ring 24 may be removably coupled to housing cover 20. In all such embodiments, inlet ring 24 of housing cover 20 may have a lip 32. Lip 32 may protrude into housing 12 when housing cover 20 is placed upon top portion 22. Although inlet ring 24 is shown as being circular, inlet ring 24 may be of any suitable shape including any oblong or elliptical shape. Housing cover 20 may have bracket mounting holes 44*a*, 44*b*, 44*c*, and 44*d* for coupling housing cover 20 to mounting bracket 14. When coupled to housing cover 20, a portion of mounting bracket 14 may pass through notches in inlet ring 24.

Mounting bracket 14 may be any structure that can support impeller 16 and motor 18 and be coupled to housing cover 20. Mounting bracket 14 may be made of any suitable material. Different portions of mounting bracket 14 may be made of any suitable material. In one embodiment, mounting bracket 14 may be made of a sturdy, low-gauge metal. Mounting bracket 14 may have mounting flanges 36*a*, 36*b*, 36*c*, and 36*d* and a base plate 38. As described in greater detail with respect with FIG. 2 below, mounting flanges 36*a*, 36*b*, 36*c*, and 36*d* may be coupled to base plate 38 by an inner web 40 and an outer web 42. Mounting bracket 14 may be coupled to housing cover 20 by fastening mounting flanges 36*a*, 36*b*, 36*c*, and 36*d* to bracket mounting holes 44*a*, 44*b*, 44*c*, and 44*d* respectively.

Impeller 16 may be any rotor that has an inlet 28 surrounded by blades 30. Impeller 16 may be made of any material including any metallic material or any rigid or flexible polymer. Blades 30 may be arranged in any configuration so that when blades 30 rotate, air enters impeller 16 through inlet 28 and is pushed out radially through side opening 26 of housing 12. Inlet 28 and blades 30 may be of any suitable size. In some embodiments, inlet 28 may be large enough to support motor 18 and motor 18 may be placed inside inlet 28. In such embodiments, impeller 16 may be directly coupled to motor 18. In other embodiments, impeller 16 may be coupled to motor 18 by a driving shaft. Impeller inlet 28 may also have a lip so that when housing cover 20 is placed upon top portion 22, inlet ring 24 of housing cover 20 protrudes into the lip of impeller inlet 28.

Motor 18 may be any electromechanical device that is capable of rotating impeller 16. In various embodiments, motor 18 may be powered by either direct current or alternating current. In some embodiments, motor 18 may cause impeller 16 to rotate in a clockwise direction while in other embodiments, motor 18 may cause impeller 16 to rotate in a counter-clockwise direction. Motor 18 may have variable speeds of rotation which may depend upon the amount of power that the motor draws.

In operation of one embodiment of the present disclosure, motor 18 is powered by an electrical source and rotates in a clockwise or counter-clockwise direction. Motor 18, which is coupled to impeller 16, is placed inside housing 12. Motor 18 drives impeller 16 and causes impeller 16 to rotate as well. The rotation of impeller 16 pulls air into impeller inlet 28 through top portion 22. Housing cover 20, with inlet ring 24, is placed upon top portion 22. Impeller 16 is placed inside housing 12 so that impeller inlet 28 is substantially aligned with inlet ring 24 in a longitudinal direction. Thus, when impeller 16 rotates, air enters impeller inlet 28 through inlet ring 24. After the air has been pulled into impeller inlet 28, it is pushed out in a radial direction by impeller blades 30. Lip 32 of inlet ring 24, which protrudes into impeller inlet 28, prevents air that has been pushed out of impeller 16 from being pulled back into impeller inlet 28. Because impeller 16 is substantially aligned with side opening 26 of housing 12 in a radial direction, the propelled air is pushed out of housing 12 through side opening 26.

In this embodiment, motor 18 and impeller 16 are coupled to mounting bracket 14. The coupled mounting bracket 14, impeller 16, and motor 18 assembly is recessed into housing 12 through top portion 22 of housing 12. Mounting bracket 14 is also coupled to housing cover 20. This embodiment provides several technical advantages. For example, this embodiment advantageously provides flexibility in sizing inlet ring 24. In this embodiment, housing cover 20 has inlet ring 24 and is also coupled to mounting bracket 14. Motor 18 is coupled to base plate 38 of mounting bracket 14 and impeller 16 is coupled to motor 18. As such, if housing cover 20 is compressed, such as by the placement of heavy objects on housing 12, both inlet ring 24 and impeller 16 move in substantially the same manner. Because housing cover 20 and impeller 16 are connected by mounting bracket 14, any displacement of housing cover 20 also displaces impeller 16. Accordingly, displacement of housing cover 20 does not affect the alignment of inlet ring 24 and impeller inlet 28. Thus, as explained in greater detail with respect to FIG. 4 below, the tolerance between inlet ring 24 and impeller inlet 28 can be minimized. In contrast, other air movers where impellers are not mounted to a mounting bracket 14 that is coupled to the housing cover 20 of an air mover housing 12 must provide a greater tolerance between impeller 16 and inlet ring 14 because any deformation or displacement of the top of those air movers changes the alignment of the inlet rings of those movers with respect to the impellers. As discussed in greater detail with respect to FIG. 4 below, minimizing the tolerance between inlet ring 24 and impeller inlet 28 maximizes the cross-sectional area of inlet ring 24 which allows for greater flow of air into impeller inlet 28 and increases the overall efficiency of air mover 10.

Another advantage of this embodiment is that the low tolerance needed between inlet ring 24 and impeller inlet 28 allows for the placement of lip 32 of inlet ring 24 close to the periphery of impeller inlet 28. Lip 32 prevents air pushed out of impeller 26 from getting pulled back into impeller inlet 28. The closer lip 32 is to the periphery of impeller inlet 28, the more efficiently lip 32 can prevent air from re-entering impeller inlet 28. This aspect of the present embodiment also increases the efficiency of the air mover.

In this example embodiment, the robustness of air mover 10 is also improved because the present embodiment maintains the alignment of impeller 16 with respect to inlet ring 24 even when housing 12 is damaged or deformed. As described earlier, inlet ring 24 may have lip 32 which protrudes into impeller inlet 28. Because inlet ring 24 and impeller 16 are both coupled to mounting bracket 14, displacement of inlet ring 24, such as by deformations of housing cover 20, does not change the alignment of lip 32 with respect to impeller inlet 28. Accordingly, the overlap between lip 32 and impeller inlet 28 is maintained.

Figure 2:
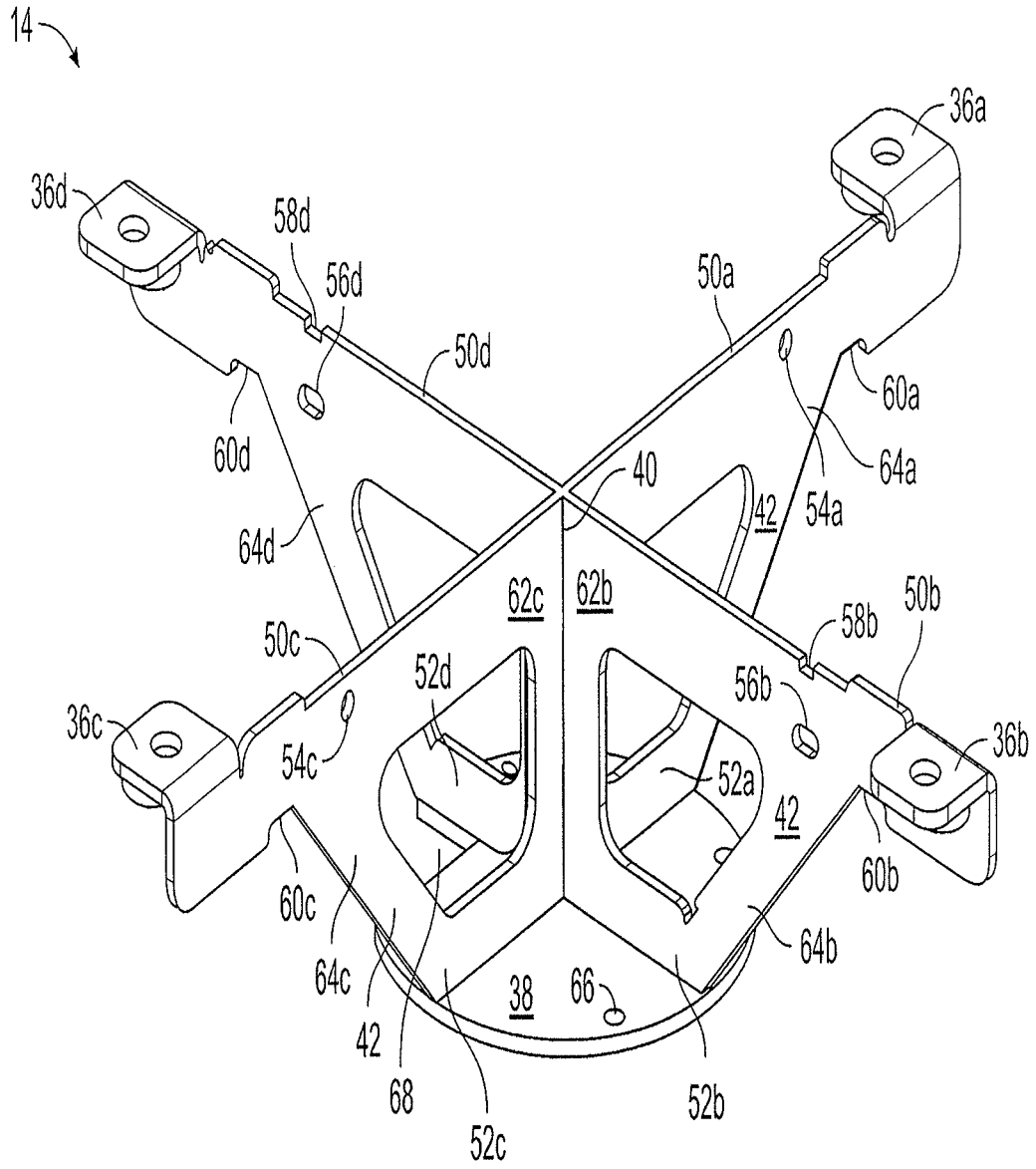
FIG. 2 illustrates a perspective view of a mounting bracket.

FIG. 2 illustrates mounting bracket 14 according to one embodiment of the present invention. In this embodiment, mounting bracket 14 has base plate 38, inner web 40, outer web 42, top chords 50*a*, 50*b*, 50*c*, and 50*d*, and bottom chords 52*a*, 52*b*, 52*c*, and 52*d*.

Top chords 50*a*, 50*b*, 50*c*, and 50*d* all extend from a first end to a second end. Top chords 50*a*, 50*b*, 50*c*, and 50*d* may be of any suitable shape including a substantially circular or rectangular shape. In the embodiment where top chords 50*a*, 50*b*, 50*c*, and 50*d* are substantially rectangular, top chords 50*a*, 50*b*, 50*c*, and 50*d* may all be oriented in a direction transverse to base plate 38. In this manner, top chords 50*a*, 50*b*, 50*c*, and 50*d* provide structural integrity to mounting bracket 14 while minimally interfering with airflow into housing 12. In one embodiment, the first end of each of top chords 50*a*, 50*b*, 50*c*, and 50*d* is coupled to mounting flanges 36*a*, 36*b*, 36*c*, and 36*d* respectively. The second end of each of top chords 50*a*, 50*b*, 50*c*, and 50*d* is coupled to inner web 40. In some embodiments, top chords 50*a* and 50*c* may have grill mounting holes 54*a* and 54*c* respectively for supporting a grill that is placed upon mounting bracket 14. Top chords 50*b* and 50*d* may also have cable tie holes 56*b* and 56*d* and cable tie notches 58*b* and 58*d* respectively. Top chords 50*a*, 50*b*, 50*c*, and 50*d* may also have impeller clearance notches 60*a*, 60*b*, 60*c*, and 60*d* respectively.

Inner web 40 may form the inner support for mounting bracket 14. Inner web 40 may comprise a number of inner chords 62*a*, 62*b*, 62*c*, and 62*d* (62*a* and 62*d* are not shown) that connect top chords 50*a*, 50*b*, 50*c*, and 50*d* to bottom chords 52*a*, 52*b*, 52*c*, and 52*d* respectively. One end of each of top chords 50*a*, 50*b*, 50*c*, and 50*d* may intersect at and be coupled to a first end of inner web 40. One end of each of bottom chords 52*a*, 52*b*, 52*c*, and 52*d* may intersect at and be coupled to a second end of inner web 40. Although this embodiment shows an inner web 40, other embodiments may not have an inner web 40. In such embodiments, outer web 42 may connect top chords 50*a*, 50*b*, 50*c*, and 50*d* to bottom chords 52*a*, 52*b*, 52*c*, and 52*d*.

Outer web 42 may form the outer support for mounting bracket 14. Outer web 42 may comprise outer chords 64*a*, 64*b*, 64*c*, and 64*d* that connect one end of each of bottom chords 52*a*, 52*b*, 52*c*, and 52*d* to a portion of top chords 50*a*, 50*b*, 50*c*, and 50*d* respectively. In this example, outer chords 64*a*, 64*b*, 64*c*, and 64*d* are angled. In other embodiments, outer chords 64*a*, 64*b*, 64*c*, and 64*d* may connect top chords 50*a*, 50*b*, 50*c*, and 50*d* to bottom chords 52*a*, 52*b*, 52*c*, and 52*d* in any suitable manner.

Bottom chords 52*a*, 52*b*, 52*c*, and 52*d*, all extend from a first end to a second end. Bottom chords 52*a*, 52*b*, 52*c*, and 52*d* may be of any suitable length including being shorter than, the same length as, or longer than top chords 50*a*, 50*b*, 50*c*, and 50*d*. In the present embodiment, bottom chords 52*a*, 52*b*, 52*c*, and 52*d* are all shorter than top chords 50*a*, 50*b*, 50*c*, and 50*d*. One end of each bottom chord 52*a*, 52*b*, 52*c*, and 52*d* is connected to outer web 42. The other end of each bottom chord 52*a*, 52*b*, 52*c*, and 52*d* is connected to inner web 40. Bottom chords 52*a*, 52*b*, 52*c*, and 52*d* may all be welded, screwed, or otherwise coupled to base plate 38 in any suitable manner.

Base plate 38 may be any surface or plate that is coupled to bottom chords 52*a*, 52*b*, 52*c*, and 52*d*. Base plate 38 may be made of any material including a material that is different from the material forming the rest of mounting bracket 14. Base plate 38 may have a number of mounting holes 66. Base plate 38 may also have a cable clearance notch 68. In some embodiments, base plate 38 may be formed by coupling multiple plates together. Although base plate 38 is shown in a circular shape, in various embodiments, base plate 38 may be of any suitable shape including an elliptical or oblong shape.

Figure 3:
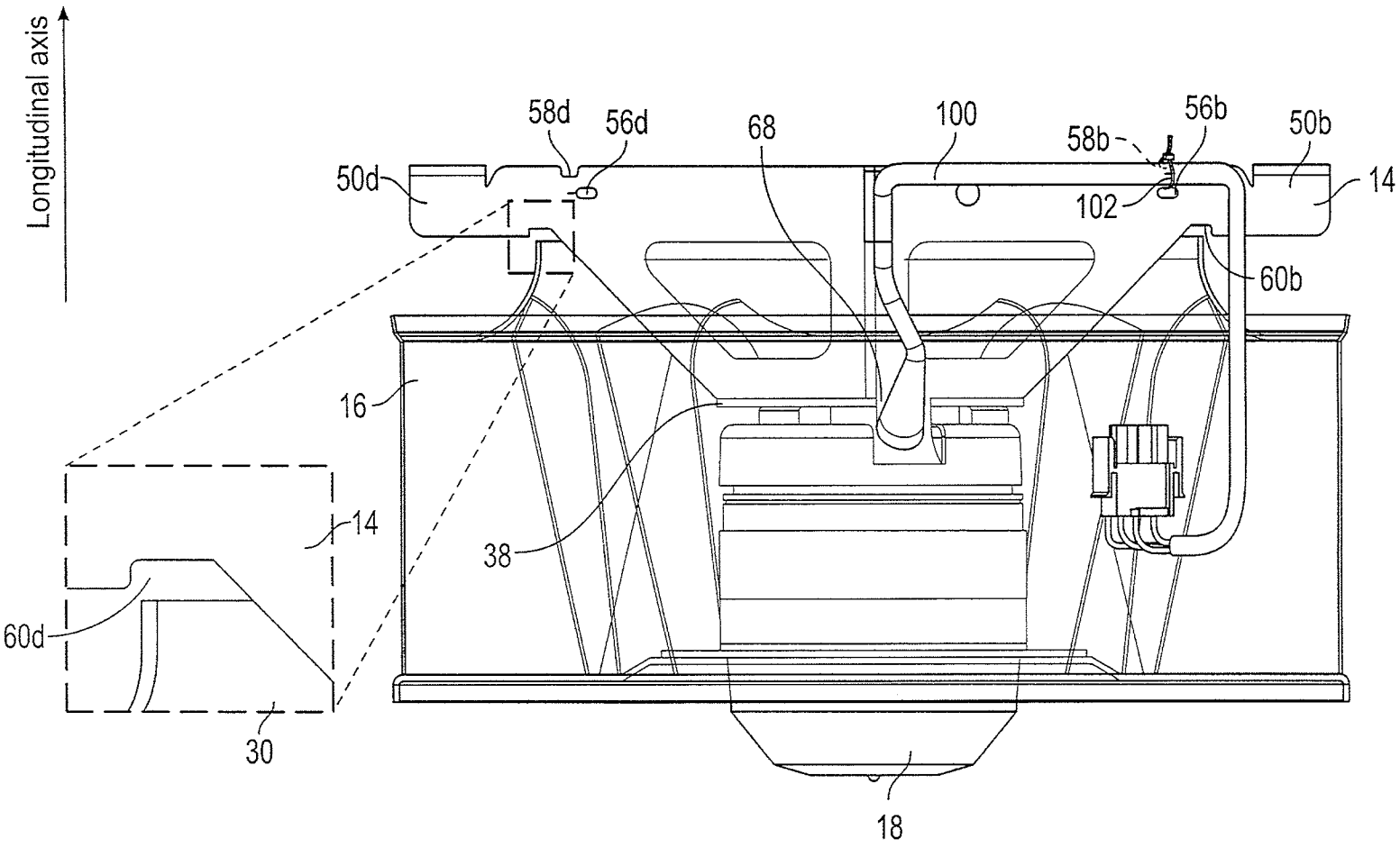
FIG. 3 illustrates a side view of a mounting bracket coupled with an impeller and a motor.

FIG. 3 illustrates one example embodiment where impeller 16 coupled to motor 18 is mounted to mounting bracket 14. In this embodiment, motor 18 is mounted to base plate 38 of mounting bracket 14. As discussed with respect to FIG. 1 above, mounting bracket 14, impeller 16, and motor 18 are recessed into housing 12 through top portion 22. Impeller 16 is coupled to motor 18 so that at least a portion of motor 18 protrudes out from below impeller 16.

FIG. 3 also illustrates a zoomed-in view of impeller clearance notch 60*d* in relation to impeller blade 30. As illustrated in the zoomed-in portion of FIG. 3, blades 30 of impeller 16 rotate around motor 18 and pass through impeller clearance notch 60*d* to avoid hitting mounting bracket 14. Impeller clearance notches 60*a*, 60*b*, 60*c*, and 60*d* thereby allow impeller blades 30 to be positioned close to top chords 50*a*, 50*b*, 50*c*, and 50*d* without coming in contact with those chords. Additionally, top chords 50*a*, 50*b*, 50*c*, and 50*d* here are of a substantially rectangular shape and are oriented in a longitudinal direction.

In this figure, a cable 100 for powering motor 18 is coupled to motor 18. Cable 100 runs through cable clearance notch 68 and is tied down to top chord 50*b* by cable tie 102. Cable tie 102 is threaded through cable tie hole 56*b* and runs over cable 100. Cable tie 102 then runs through cable tie notch 58*b* to make a loop over top chord 50*b*. Cable tie 102 thereby securely fastens cable 100 to top chord 50*b* without interfering with air flow into housing 12 and keeps cable 100 out of impeller 16.

Figure 4:
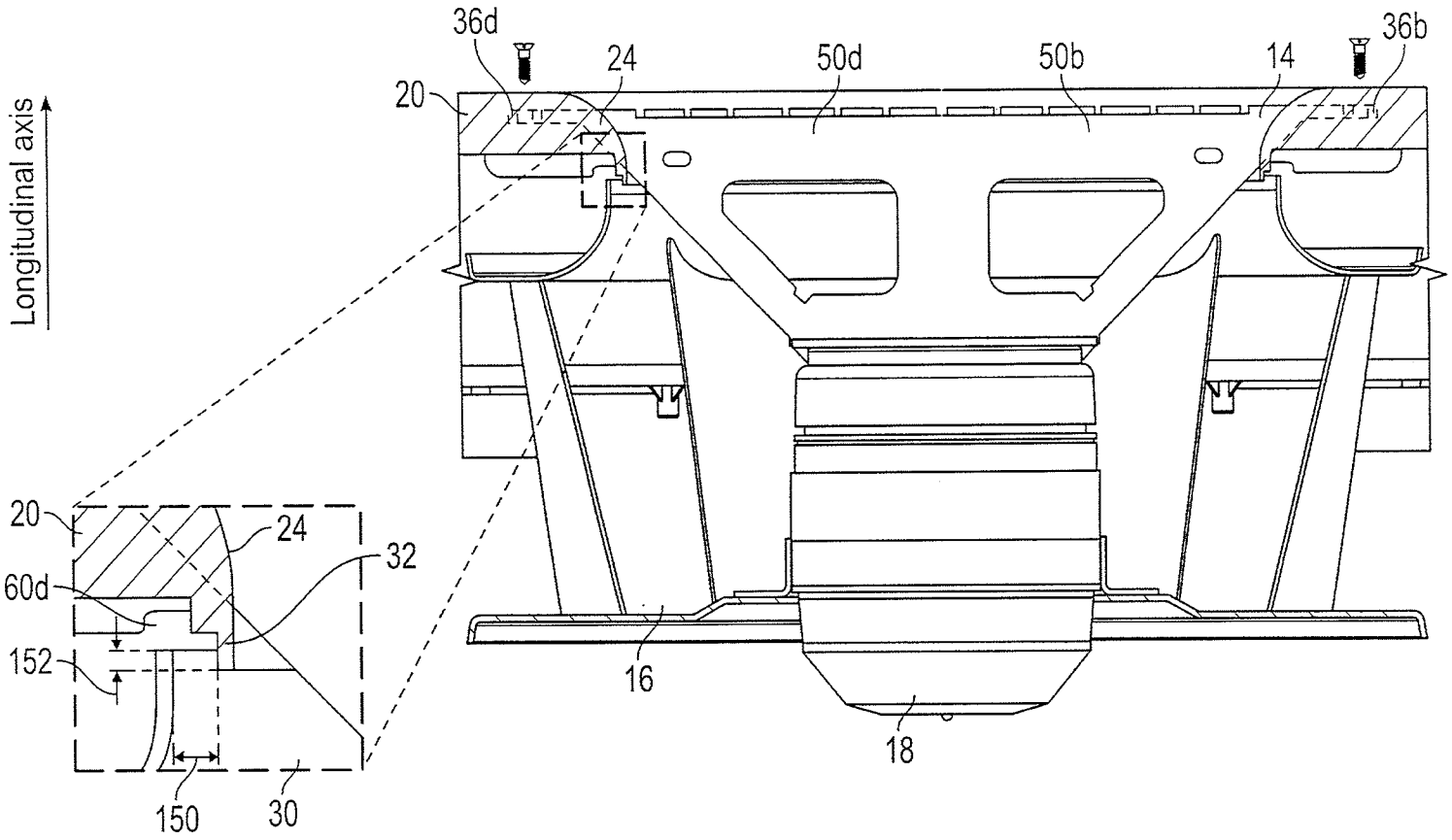
FIG. 4 illustrates a side view of the mounting bracket mounted to an impeller, a motor, and a housing cover with an inlet ring.

FIG. 4 further illustrates the example embodiment of FIG. 3 where mounting bracket 14 is coupled to housing cover 20 with inlet ring 24. Mounting bracket 14 is mounted onto housing cover 20 by fasteners attached to mounting flanges 36*a*, 36*b*, 36*c*, and 36*d* (36*a* and 36*c* are not shown). FIG. 4 also illustrates a zoomed-in view of tolerance 150 between inlet ring 24 and impeller blade 30 as well as overlap 152 between blade 30 and inlet ring 24.

In operation, motor 18 drives impeller 16, causing impeller 16 to rotate in either a clockwise or counter-clockwise direction. The rotation of impeller 16 pulls air into impeller inlet 28 in a longitudinal direction. Air flows into impeller 16 relatively unobstructed because motor 18 is recessed below impeller 16 and because top chords 50*a*, 50*b*, 50*c*, and 50*d* are oriented substantially longitudinally. Accordingly, inflowing air experiences low surface resistance by top chords 50*a*, 50*b*, 50*c*, and 50*d* and motor 18.

As mentioned above in relation to FIG. 1, this embodiment provides several technical advantages. First, in this embodiment, the efficiency of impeller 16 is increased because tolerance 150 between impeller inlet 28 and inlet ring 24 can be minimized. Tolerance 150 is the gap between inlet ring 24 and impeller inlet 28 in a radial direction. In this embodiment, lip 32 of inlet ring 24 protrudes into impeller inlet 28. Lip 32 thus prevents air pushed out by impeller blades 30 from being pulled back into impeller inlet 28. Tolerance 150 ensures that lip 32 of inlet ring 24 remains aligned with impeller inlet 28 even as impeller 16 moves or is displaced due to wear and tear. As tolerance 150 increases, i.e. there is a greater gap between inlet ring 24 and impeller inlet 28, the surface area of impeller inlet 28 that is able to draw in air decreases. As this surface area decreases, the efficiency of impeller 16 decreases as well.

In this embodiment, tolerance 150 can be minimized because impeller 16, motor 18, and housing cover 20, including inlet ring 24, are all coupled to the same mounting bracket 14. Thus, if there is any displacement of housing cover 20, impeller 16 and inlet ring 24 are displaced in the same manner and they remain aligned with each other. Thus, it is not necessary to leave a large tolerance 150 between impeller inlet 28 and inlet ring 24 to ensure that impeller inlet 28 and inlet ring 24 remain aligned. Because tolerance 150 can be minimized, the efficiency of impeller 16 is maximized.

Second, because this embodiment minimizes tolerance 150, lip 32 of inlet ring 24 can be placed close to the periphery of impeller inlet 28. Lip 32 prevents air pushed out of impeller 26 from getting pulled back into impeller inlet 28. Thus, the closer lip 32 is to the periphery of impeller inlet 28, the more efficiently lip 32 prevents air from re-entering impeller inlet 28. Because air cannot reenter impeller inlet 28 as more air is pushed out of impeller 16, the propelled air is forced to exit housing 12 through side opening 26 thereby increasing the efficiency of the overall air mover.

Third, this embodiment retains overlap 152 between blade 30 and inlet ring 24 despite displacement and deformation of housing 12 that may occur from time to time. In this embodiment, housing cover 20 is positioned so that lip 32 of inlet ring 24 protrudes into impeller inlet 28. A portion of blades 30, which form the periphery of impeller inlet 28, overlap with lip 32 where lip 32 protrudes into impeller inlet 28 in a longitudinal direction. This overlap 152 ensures that air pushed out of blades 30 is not pulled back into impeller inlet 28. As described earlier, because inlet ring 24 and impeller 16 are both coupled to mounting bracket 14, displacement of inlet ring 24, such as by deformations of housing cover 20, does not change the alignment of lip 32 with respect to impeller inlet 28. Accordingly, overlap 152 between lip 32 and impeller inlet 28 is not affected by any such displacements or deformations. This embodiment thus ensures the robustness of air mover 10 by maintaining its efficiency for a long period of time.

Figure 5A:
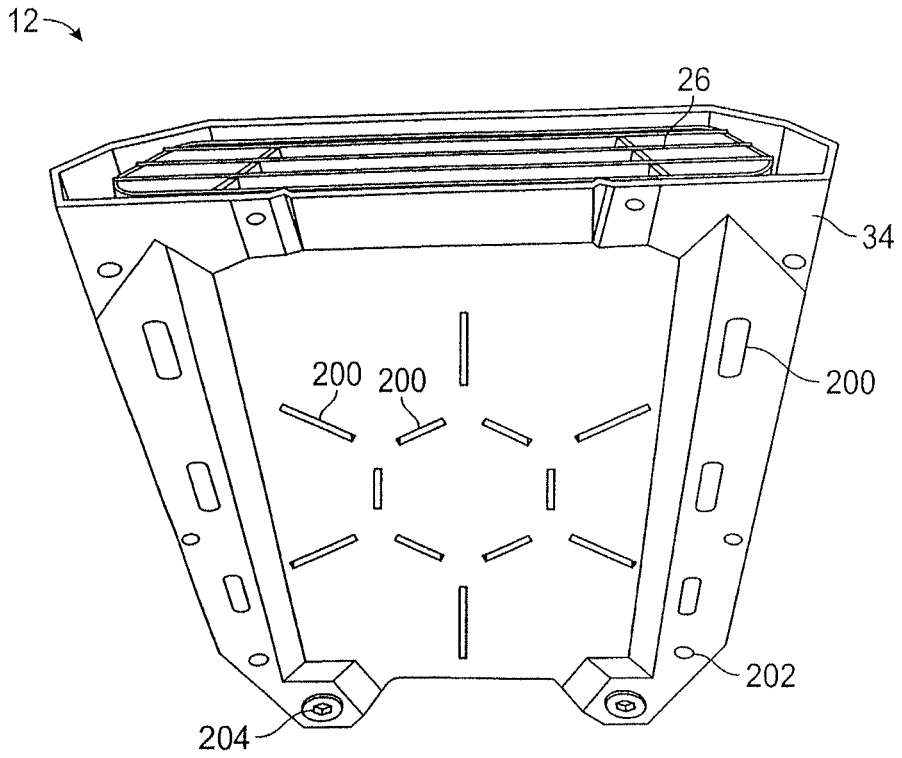
FIG. 5A illustrates the bottom of an air mover.

FIG. 5A illustrates housing 12 laying on its side showing the bottom of base portion 34 and side opening 26 of housing 12. As shown, base portion 34 has apertures 200. Base portion 34 also has protrusions 202 and legs 204.

In operation, housing 12 sits on legs 204. As impeller 16 pushes air out of impeller inlet 28, most of the air flows out of housing 12 through side opening 26. Some air, however, also flows out of apertures 200 to dry, heat, or cool the surface beneath air mover 10.

Figure 5B:
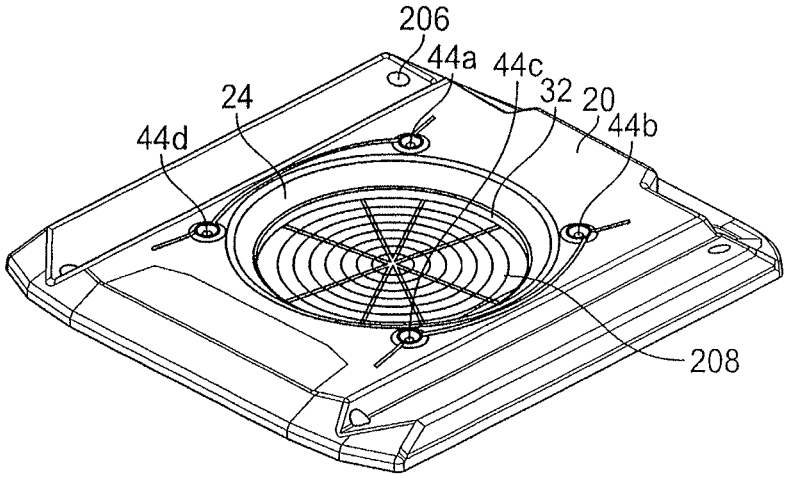
FIG. 5B illustrates the top cover of an air mover.

FIG. 5B illustrates housing cover 20 showing inlet ring 24, lip 32, bracket mounting holes 44*a*, 44*b*, 44*c*, and 44*d*, recesses 206, and grill 208. Housing cover 20 may couple with mounting bracket 14 by fastening mounting flanges 36*a*, 36*b*, 36*c*, and 36*d* to bracket mounting holes 44*a*, 44*b*, 44*c*, and 44*d*. In some embodiments, protrusions 202 of base portion 34 may be placed inside recesses 206 to stack multiple air movers 10. In one embodiment, grill 208 may be placed inside inlet ring 24 to prevent foreign objects from entering housing 12.

Figure 6:
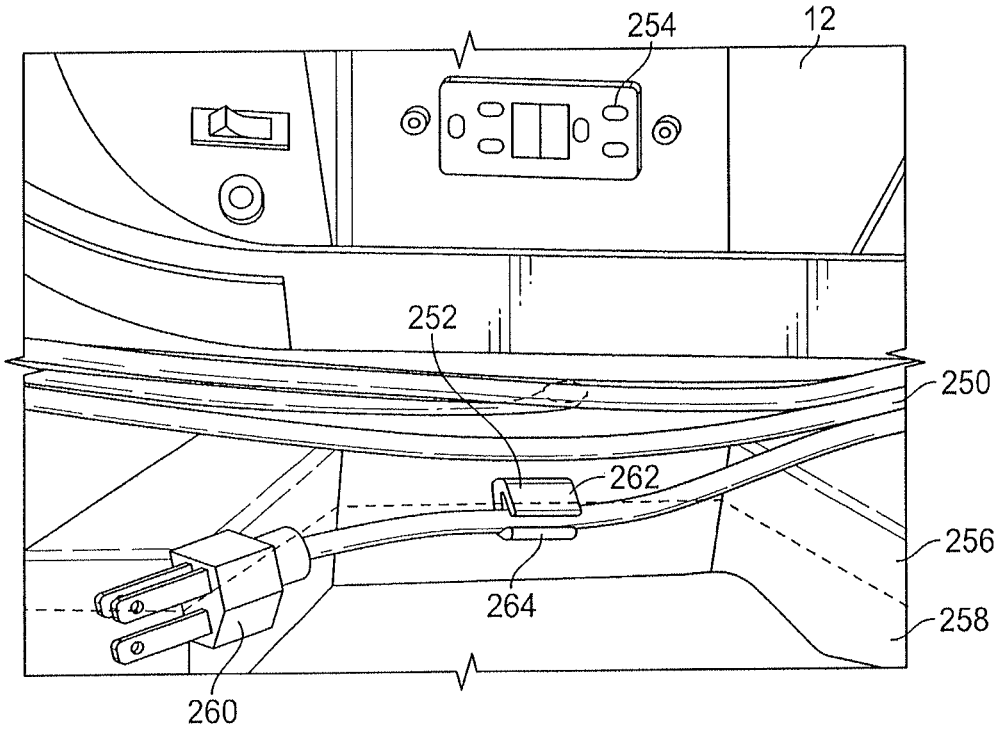
FIG. 6 illustrates a side view of an air mover housing.

FIG. 6 illustrates one side of housing 12 showing a power cord 250, a power cord clip 252, and a built-in outlet 254. In this example embodiment, power cord 250 is coupled to motor 18 through housing 12. As shown, power cord 250 is coupled to housing 12 above power cord clip 252. Further, in this example embodiment, base portion 34 of housing 12 is formed by coupling a housing body portion 256 to a housing bottom portion 258.

Power cord 250 may be any cable that can provide electric power to motor 18. In various embodiments, power cord 250 may be coupled to any suitable plug 260.

Power cord clip 252 may be any clip in which power cord 250 may be placed for storing power cord 250. Power cord clip 252 may be formed of a top half 262 and a bottom half 264. For ease of machining and for flexibility of clip 252, top half 262 may be coupled to body portion 256 of housing 12 while bottom half 264 may be coupled to bottom portion 258 of housing 12. Power cord clip 252 may be placed above or below power cord 250 at its coupling point to housing 12 so that power cord 250 may be wrapped in either a clockwise or counter-clockwise direction and terminate close enough to clip 252 to be positioned inside clip 252 for storage.

Outlet 254 may be any suitable interface for connecting an electrically operated device to a power supply. Outlet 254 may direct a portion of the power drawn by power cord 250 to another electrical device.

In operation, power cord 250 may be coupled to motor 18 at one end and a power source by plug 260. Motor 18 may draw power from the power source and power cord 250 may transfer the power from the power source to motor 18. Power cord 250 may also be coupled to outlet 254 so that when power cord 250 is coupled to a power source, a user may couple another electrical device to outlet 254 and draw power from outlet 254.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. The methods may include more, fewer, or other steps. Additionally, steps may be performed in any suitable order. Additionally, operations of the systems and apparatuses may be performed using any suitable logic. As used in this document, "each" refers to each member of a set or each member of a subset of a set.

Although several embodiments have been illustrated and described in detail, it will be recognized that substitutions and alterations are possible without departing from the spirit and scope of the present disclosure, as defined by the appended claims. To aid the Patent Office, and any readers of any patent issued on this application in interpreting the claims appended hereto, applicants wish to note that they do not intend any of the appended claims to invoke 35 U.S.C. § 112(f) as it exists on the date of filing hereof unless the words "means for" or "step for" are explicitly used in the particular claim.

What is claimed is:

1. An air mover comprising:

a housing having a top portion;

a mounting bracket recessed into the top portion of the housing, the mounting bracket comprising:

a plurality of top chords intersecting at a first portion of an inner web and a plurality of bottom chords intersecting at a second portion of the inner web wherein the inner web comprises a plurality of vertical chords extending from the first portion of the inner web to the second portion of the inner web;

the plurality of top chords each having an impeller clearance notch and a mounting flange;

a plurality of outer chords wherein each outer chord extends from a corresponding top chord to a corresponding bottom chord; and a motor coupled to the mounting bracket;

an impeller coupled to the motor wherein the impeller comprises an inlet and a plurality of blades, the impeller being positioned so that a portion of the plurality of blades pass through the plurality of impeller clearance notches as the impeller rotates; and a housing cover having an inlet ring positioned on the top portion of the housing wherein the motor and the impeller are coupled to the housing cover via the mounting bracket using the mounting flanges and a portion of the inlet ring protrudes into the impeller inlet inside the housing.

2. The air mover of claim 1, wherein the plurality of top chords further comprise a plurality of notches for positioning a grill.

3. The air mover of claim 1, further comprising a power cord that is coupled to the housing directly above a power cord clip and the power cord clip is operable to hold the power cord.

4. The air mover of claim 1, wherein the housing cover comprises a plurality of recesses and wherein the housing further comprises a base portion having a plurality of protrusions, the protrusions being operable to fit within the recesses of another housing to stack a plurality of air movers.

5. The air mover of claim 4, wherein the base portion of the housing further comprises a plurality of apertures for air flow out of the housing.

6. The air mover of claim 1, wherein the mounting bracket further comprises a plurality of cable tie locating holes and cable tie locating notches for securing a cable with a fastener.

7. The air mover of claim 1, wherein the impeller inlet has a lip and the inlet ring of the housing cover protrudes into the impeller inlet lip so that airflow into impeller inlet through the inlet ring is increased and extraneous airflow into the impeller inlet is decreased.

8. The air mover of claim 1, wherein the inlet ring of the housing cover has a lip and the inlet ring lip protrudes into the impeller inlet so that airflow into impeller inlet through the inlet ring is increased and extraneous airflow into the impeller inlet is decreased.

9. A method of assembling an air mover comprising:

coupling a motor to a mounting bracket, the mounting bracket comprising:

a plurality of top chords intersecting at a first portion of an inner web and a plurality of bottom chords intersecting at a second portion of the inner web wherein the inner web comprises a plurality of vertical chords extending from the first portion of the inner web to the second portion of the inner web;

the plurality of top chords each having an impeller clearance notch and a mounting flange;

a plurality of outer chords wherein each outer chord extends from a corresponding top chord to a corresponding bottom chord;

coupling an impeller to the motor wherein the impeller comprises an inlet and a plurality of blades, the impeller being positioned so that a portion of the plurality of blades pass through the plurality of impeller clearance notches of the mounting bracket as the impeller rotates;

recessing the mounting bracket into a housing through a top portion of the housing;

placing a housing cover onto the top portion of the housing, the housing cover comprising an inlet ring; and coupling the mounting bracket via the mounting flanges onto the housing cover so that a portion of the inlet ring protrudes into the impeller inlet inside the housing.

10. The method of claim 9, wherein the plurality of top chords further comprise a plurality of notches for positioning a grill.

11. The method of claim 9, further comprising a power cord that is coupled to the housing directly above a power cord clip and the power cord clip is operable to hold the power cord.

12. The method of claim 9, wherein the housing cover comprises a plurality of recesses and wherein the housing further comprises a base portion having a plurality of protrusions, the protrusions being operable to fit within the recesses of another housing to stack a plurality of air movers.

13. The method of claim 9, wherein the base portion of the housing further comprises a plurality of apertures for air flow out of the housing.

14. The method of claim 9, wherein the mounting bracket further comprises a plurality of cable tie locating holes and cable tie locating notches for securing a cable with a fastener.

15. The method of claim 9, wherein the impeller inlet has a lip and the inlet ring of the housing cover protrudes into the impeller inlet lip so that airflow into impeller inlet through the inlet ring is increased and extraneous airflow into the impeller inlet is decreased.

16. The air mover of claim 9, wherein the inlet ring of the housing cover has a lip and the inlet ring lip protrudes into the impeller inlet so that airflow into impeller inlet through the inlet ring is increased and extraneous airflow into the impeller inlet is decreased.

* * * * *